US007074057B2

(12) United States Patent
Chiran et al.

(10) Patent No.: US 7,074,057 B2
(45) Date of Patent: Jul. 11, 2006

(54) TRANSMISSION APPARATUS

(75) Inventors: Kiyohiko Chiran, Aichi (JP); Takashi Suyama, Osaka (JP)

(73) Assignee: J. S. T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/489,828

(22) PCT Filed: Sep. 13, 2002

(86) PCT No.: PCT/JP02/09413

§ 371 (c)(1),
(2), (4) Date: Mar. 17, 2004

(87) PCT Pub. No.: WO03/026077

PCT Pub. Date: Mar. 27, 2003

(65) Prior Publication Data

US 2004/0266230 A1 Dec. 30, 2004

(30) Foreign Application Priority Data

Sep. 17, 2001 (JP) ..... 2001-281917

(51) Int. Cl.
*H01R 13/648* (2006.01)

(52) U.S. Cl. ..... 439/92; 439/607; 439/939

(58) Field of Classification Search ..... 439/92, 439/607, 610, 939
See application file for complete search history.

(56) References Cited

U.S. PATENT DOCUMENTS 5,112,251 A * 5/1992 Cesar ..... 439/607
5,162,000 A * 11/1992 Frantz ..... 439/607
5,456,618 A * 10/1995 Nakamura ..... 439/610
5,667,407 A * 9/1997 Frommer et al. ..... 439/610
5,772,471 A * 6/1998 Buck ..... 439/607
5,971,811 A 10/1999 Mori et al.
6,206,731 B1 * 3/2001 Kuo ..... 439/610
6,231,385 B1 5/2001 Kuo
6,786,742 B1 * 9/2004 Matsuoka ..... 439/95
2004/0002263 A1 * 1/2004 Matsuoka ..... 439/610

FOREIGN PATENT DOCUMENTS

JP 03-29895 Y2 6/1991
JP 06-132690 A1 5/1994
JP 09-213420 A1 8/1997
JP 2580724 Y2 7/1998

OTHER PUBLICATIONS

International Search Report (English Translation).
English Translation of the International Preliminary Examination Report.
European Search Report, Application No.: 02763027.6 - 2214 PCT/JP0209413, dated Mar. 6, 2006.

* cited by examiner

*Primary Examiner*—James R. Harvey
(74) *Attorney, Agent, or Firm*—Rader, Fishman & Grauer PLLC

(57) ABSTRACT

There is provided a transmission device (A) arranged in an electronic apparatus (1) having a circuit board (3) for input and/or output and a conductive body (9). The transmission device (A) comprises a relay cable (7) having first and second ends (7*a*, 7*b*). The first end (7*a*) of the relay cable (7) is connected to the circuit board (3). A receptacle type connector (11) attached to a reverse surface (9*a*) of the body (9) is provided at the second end (7*b*) of the relay cable. In order to prevent generation of radiation noises from the relay cable (7), a metal shell in the receptacle type connector (11) is grounded to the body (9).

15 Claims, 9 Drawing Sheets

TRANSMISSION APPARATUS

TECHNICAL FIELD

The present invention relates to a transmission device in an electronic apparatus using a relay cable and more particularly, to a transmission device used for high-speed data transmission.

BACKGROUND ART

Data of which real time properties are required, for example, digital moving data must be transmitted at high speed. Therefore, in recent years, serial interfaces comprising the function of real time transmission, for example, cables and connectors conforming to an IEEE 1394 (Institute of Electrical and Electronics Engineers 1394) high-speed serial bus standard have been employed.

In an AV (Audio-Visual) apparatus such as a TV (Television) receiver, for example, receptacle type connectors are respectively arranged on a front surface and a rear surface of the apparatus, to respectively connect to the receptacle type connectors corresponding plug type connectors connected to a video camera, for example.

In this case, when I/O (input-output) boards are respectively provided in a front part and a rear part of the apparatus, and the boards are respectively equipped with the receptacle type connectors on the front and reverse surfaces, the manufacturing cost rises.

Therefore, it is considered that the board is arranged only in the rear part of the apparatus, and the board in the rear part and the receptacle type connector arranged on the front surface are connected to each other by a relay cable. In this case, however, noises radiated from the relay cable may affect components in the apparatus.

Therefore, it is also considered that a shielding line in the relay cable is connected to a ground line in the board. In the case, however, noises are radiated to the ground line in the board, so that the impedance matching of each of the lines in the board may be destroyed.

In a game apparatus that performs image formation, for example, the same type of problems also arises in a case where an I/O board arranged in the apparatus and a receptacle type connector are connected to each other by a relay cable.

The present invention has been made in view of the foregoing problems and has for its object to provide a transmission device capable of reducing radiation noises in an apparatus.

DISCLOSURE OF INVENTION

In order to attain the above-mentioned object, the present invention provides, in a preferred mode, a transmission device arranged in an electronic apparatus having a circuit board for input and/or output and a conductive body, which comprises a relay cable having first and second ends and the first end of which is connected to the circuit board, and a receptacle type connector provided at the second end of the relay cable and attached to a reverse surface of the body of the electronic apparatus. The receptacle type connector comprises an insulative connector housing for holding a plurality of contacts, and a conductive metal shell surrounding at least a part of the connector housing. The shell is grounded to the body.

In this mode, the metal shell in the receptacle type connector is grounded to the body, thereby making it possible to prevent the generation of such radiation noises from the relay cable that affect components in the electronic apparatus. That is, outside noises can be shut out at an inlet to the electronic apparatus so as not to affect a ground line in the circuit board.

BEST MODE FOR CARRYING OUT THE INVENTION

A preferred embodiment of the present invention will be described while referring to the accompanying drawings.

Figure 1:
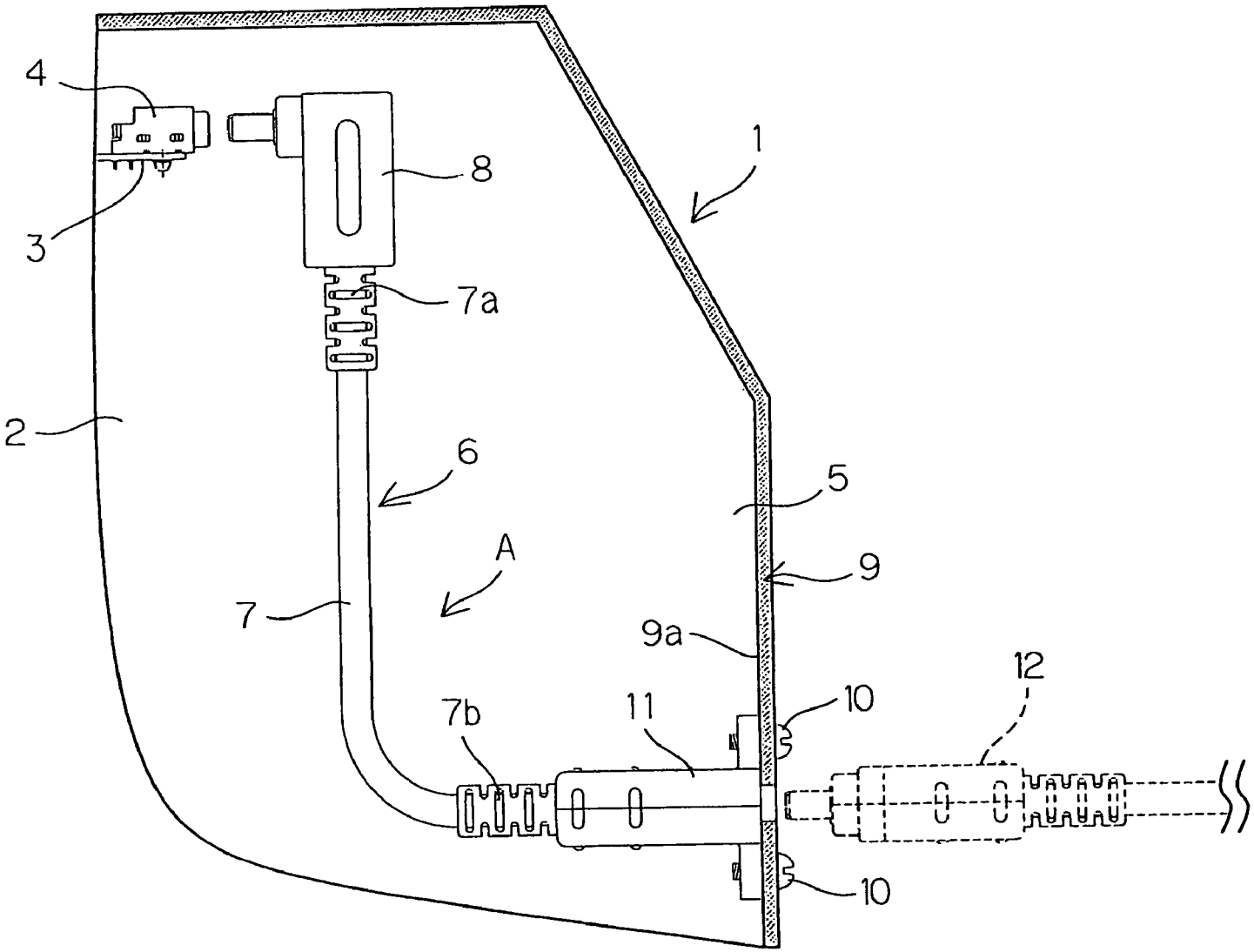
FIG. 1 is a schematic plan view of an electronic apparatus to which a transmission device according to an embodiment of the present invention is applied.

FIG. 1 is a schematic plan view of an electronic apparatus to which a transmission device according to an embodiment of the present invention is applied. Referring to FIG. 1, a transmission device A comprises a receptacle type connector 4 mounted on a circuit board 3 in a rear part 2 of an electronic apparatus 1, and a relay cable unit 6 extending from the receptacle type connector 4 to a front part 5 of the apparatus 1.

The relay cable unit 6 comprises a relay cable 7 having first and second ends 7*a* and 7*b*, a plug type connector 8 provided at the first end 7*a* of the relay cable 7 and connected to the receptacle type connector 4, and a receptacle type connector 11 provided at the second end 7*b* of the relay cable 7 and attached to a reverse surface 9*a* of an outer wall of a conductive body 9 of the electronic apparatus 1 in the front part 5 of the electronic apparatus 1 using screws 10.

To the receptacle type connector 11, a corresponding plug type connector 12 can be connected from outside for inputting a signal to the electronic apparatus 1, thereby achieving transmission conforming to a serial interface (e.g., an IEEE 1394 high-speed serial bus standard) for allowing high-speed transmission, for example.

The present embodiment is characterized in that the receptacle type connector 11 in the relay cable unit 6 extending from the circuit board 3 in the rear part 2 of the electronic apparatus 1 to the front part 5 of the electronic apparatus 1 is attached to the front part 5 of the electronic apparatus 1, and a conductive shell 15 (see FIG. 2), described later, in the receptacle type connector 11 is conducted to the body 9 in the front part 5 of the electronic apparatus 1 to ensure grounding, thereby preventing radiation noises from being generated from the relay cable unit 6 serving as a connection in the apparatus and preventing the radiation noises from adversely affecting the other components in the electronic apparatus 1.

Figure 2:
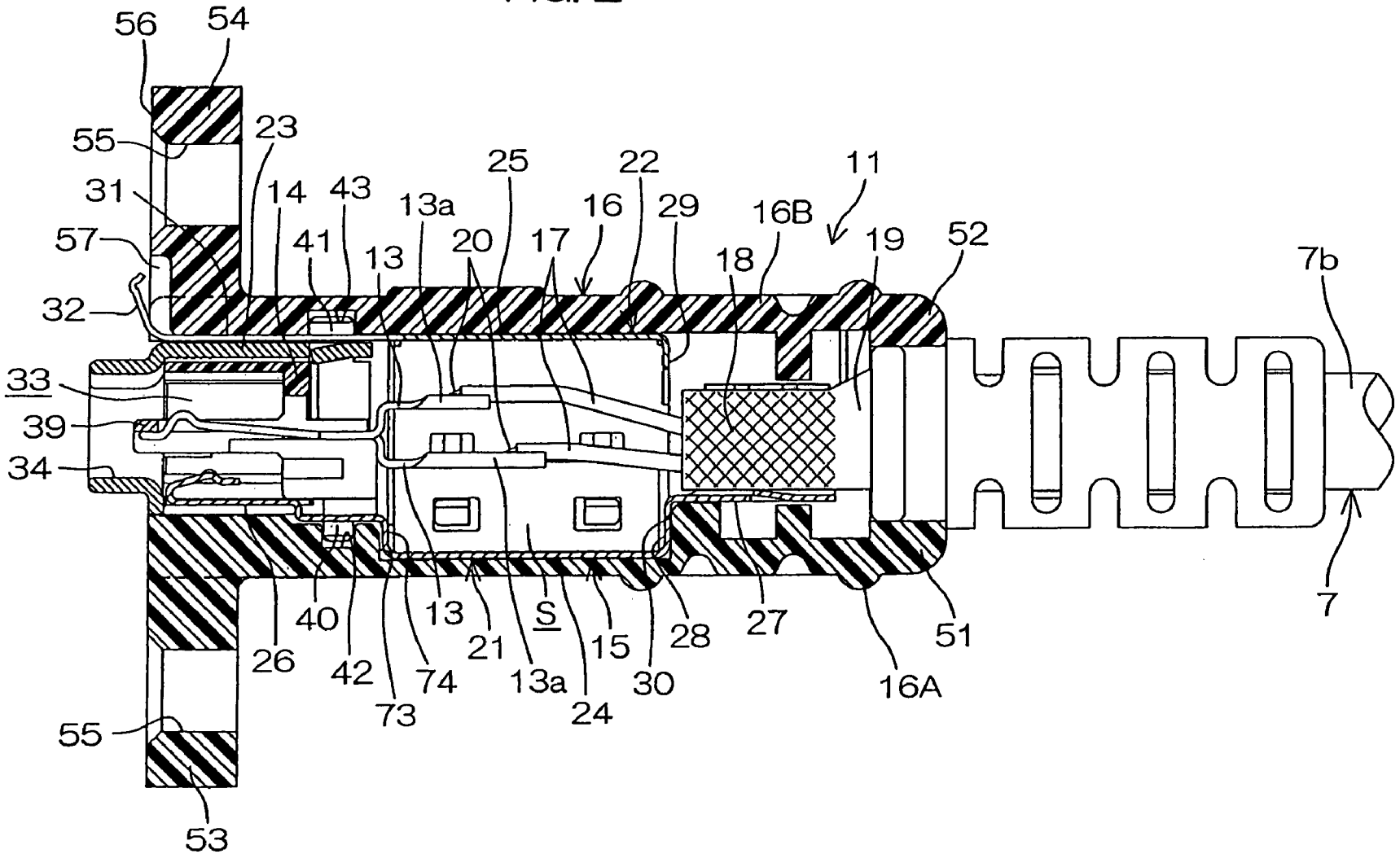
FIG. 2 is a cross-sectional view of a receptacle type connector.
Figure 8:
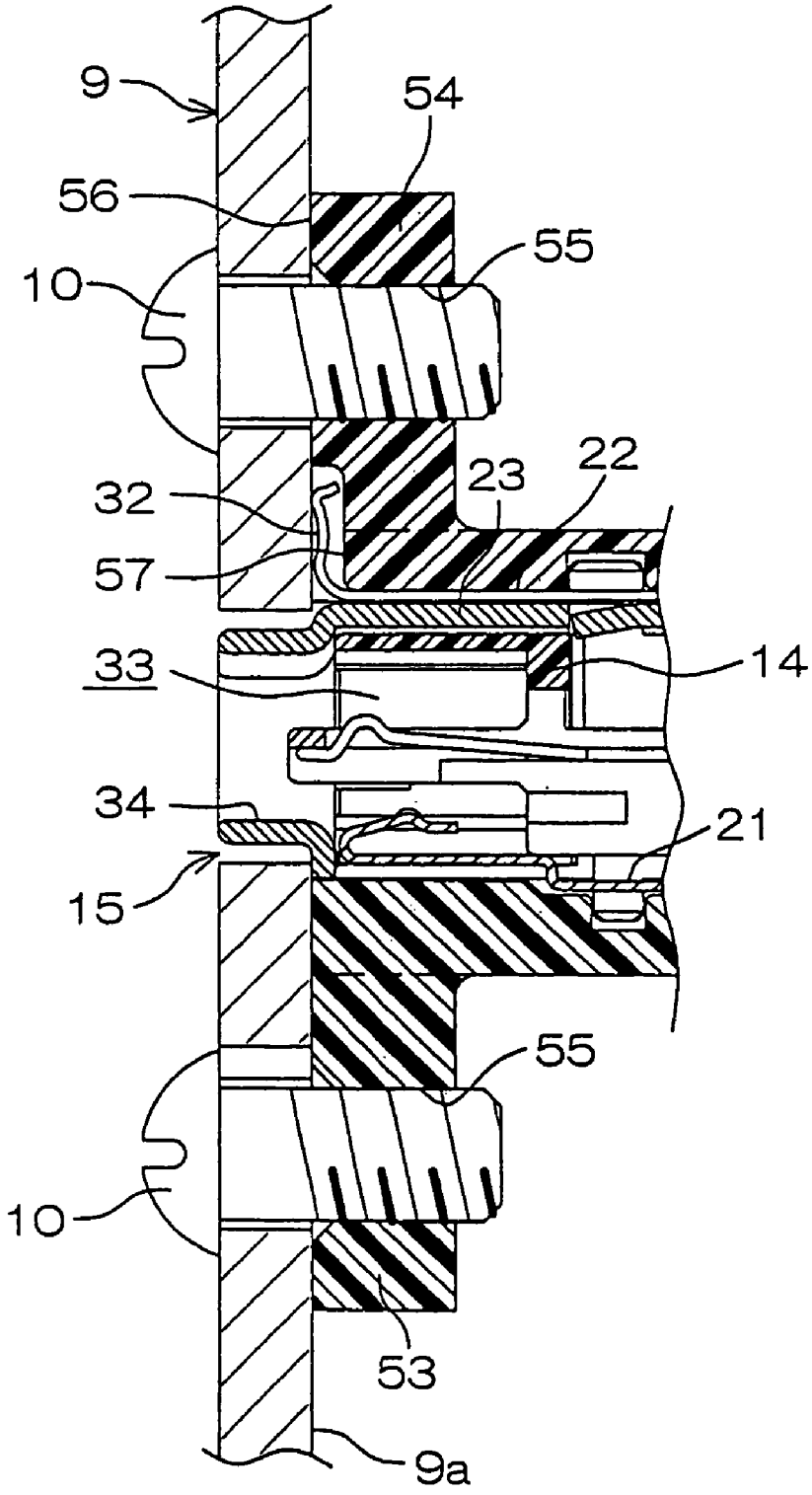
FIG. 8 is a schematic cross-sectional view showing a state where a shell in the receptacle type connector is grounded to a body of the electronic apparatus.
Figure 9:
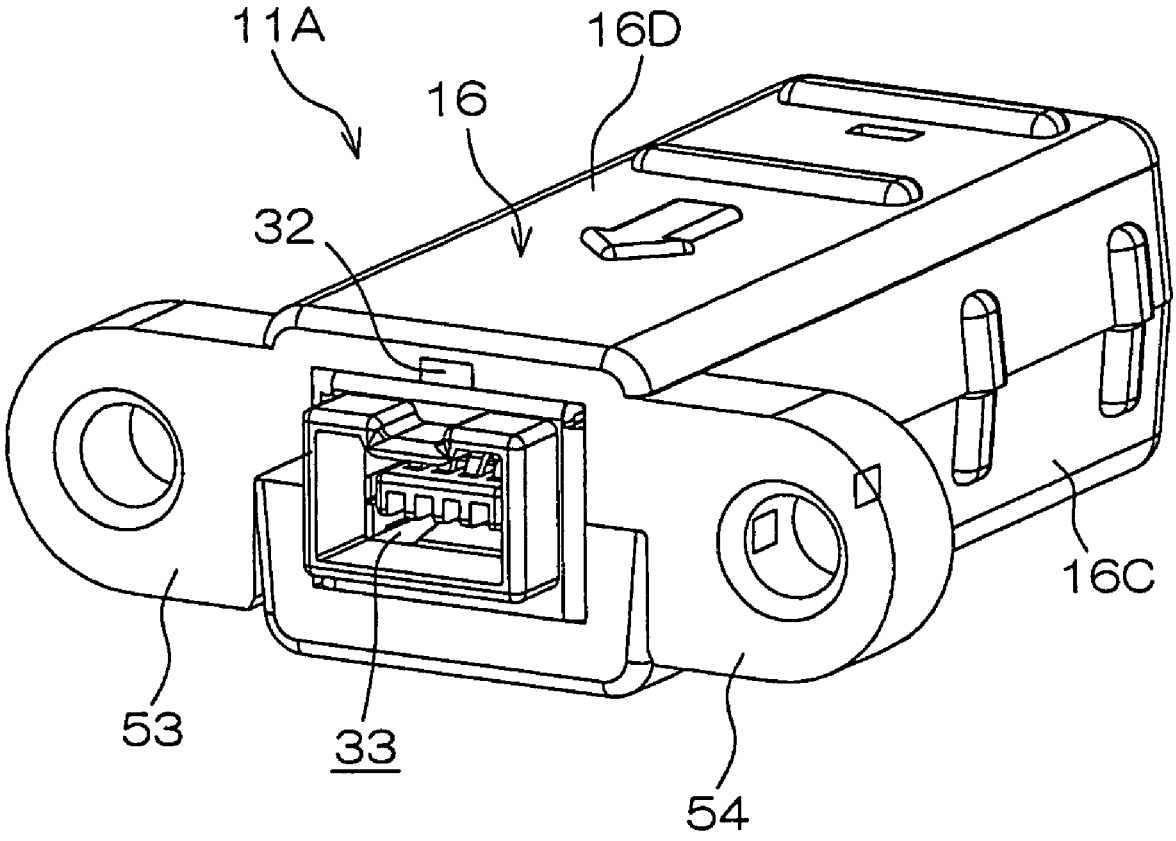
FIG. 9 is a schematic perspective view of a receptacle type connector in a transmission device according to another embodiment of the present invention.

Referring to FIG. 2, the receptacle type connector 11 comprises an insulative connector housing 14 for holding a plurality of contacts 13, a conductive metal shell 15 surrounding the periphery of the connector housing 14, and a cover housing 16 accommodating and holding the connector housing 14 and the shell 15 and attached to the reverse surface of the body 9 of the electronic apparatus 1 (see FIG. 8).

Referring to FIG. 2 again, the cover housing 16 is constructed by combining a pair of division housings 16A and 16B. The division housings 16A and 16B respectively comprise halved main sections 51 and 52 in a tub shape and mounting flanges 53 and 54 respectively provided at the fronts of the main sections 51 and 52 and extending in directions opposite to each other. A screw through hole 55 through which the screw 10 is to be inserted for mounting on the body 9, as shown in FIG. 8, is formed in each of the mounting flanges 53 and 54.

Furthermore, a mounting surface 56 (a surface opposed to the reverse surface 9*a* of the body 9) of the mounting flange 54 in the division housing 16B is provided with a recess 57 accommodating a elastic tongue member 32, when the elastic tongue member 32 for grounding, described later, is elastically deformed in contact with the reverse surface 9*a* of the body 9.

Referring to FIG. 2 again, the relay cable 7 comprises a coated signal line 17 composed of four poles, for example (only two poles are illustrated in the drawing), a conductive shield 18 composed of a net-shaped line, for example, surrounding the coated signal line 17, and a coating section 19 surrounding the conductive shield 18. A lead 13*a* at a rear end of each of the contacts 13 and a stripped end of the corresponding signal line 17 in the relay cable 7 are connected to each other by a soldering section 20.

Figure 3:
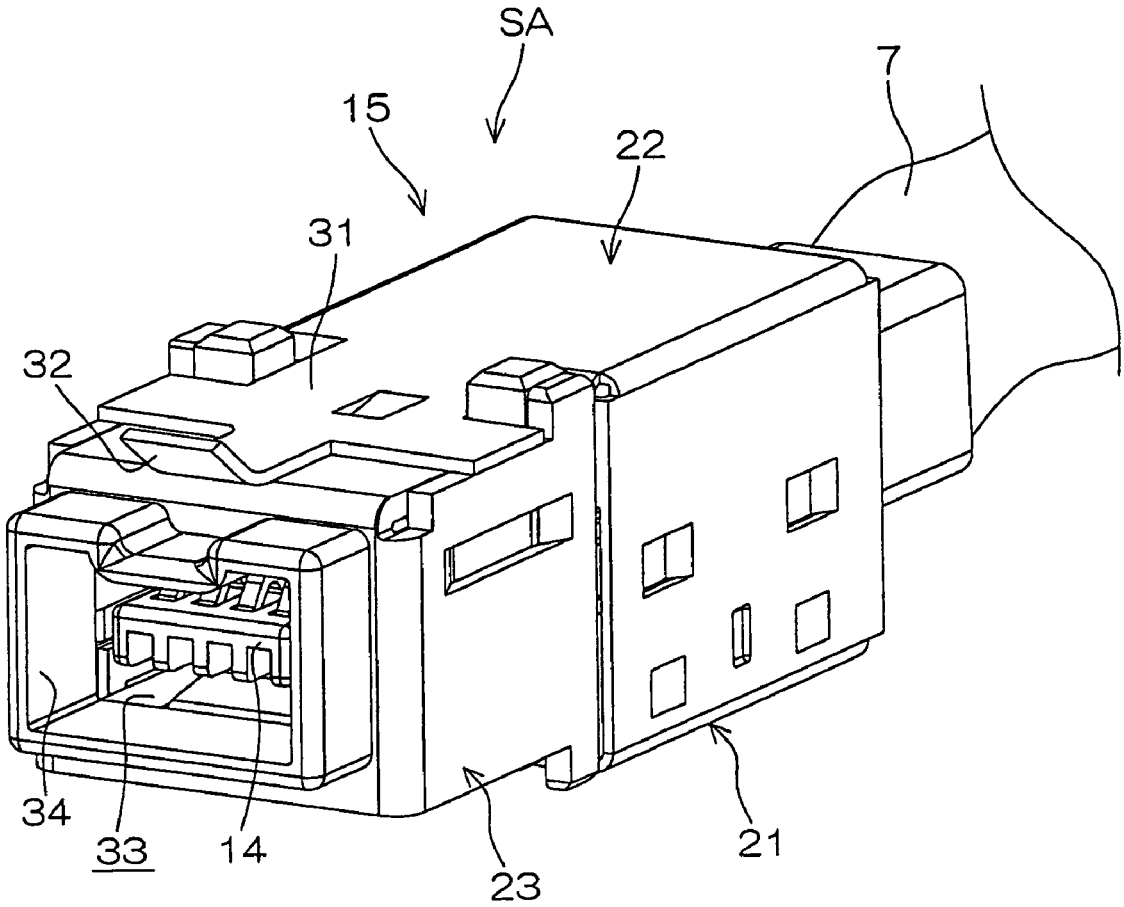
FIG. 3 is a perspective view of the receptacle type connector in a state where a cover housing is removed.

Referring to FIG. 2 and FIG. 3 which is a perspective view of a sub-assembly SA in a state where the cover housing 16 is removed, the shell 15 comprises a first shell member 21, a second shell member 22, and a third shell member 23 respectively formed of sheet metals. Although the principal function, viewed as a whole, of the shell 15 is electromagnetic shielding, different functions are respectively required for the first, second, and third shell members 21, 22, and 23 respectively constituting their areas. Therefore, each of the shell members 21, 22, and 23 is formed of material corresponding to the functions required respectively.

For example, the first shell member 21 has a barrel 27 for sticking by pressure, as described later, so that it is formed of brass which is superior in properties of sticking by pressure. The second shell member 22 has the elastic tongue member 32 for grounding, so that it is formed of stainless steel in order to ensure strength. The third shell member 23 has a drawn portion, as described later, so that it is formed of mild steel suitable for formation by a drawing operation.

Figure 5:
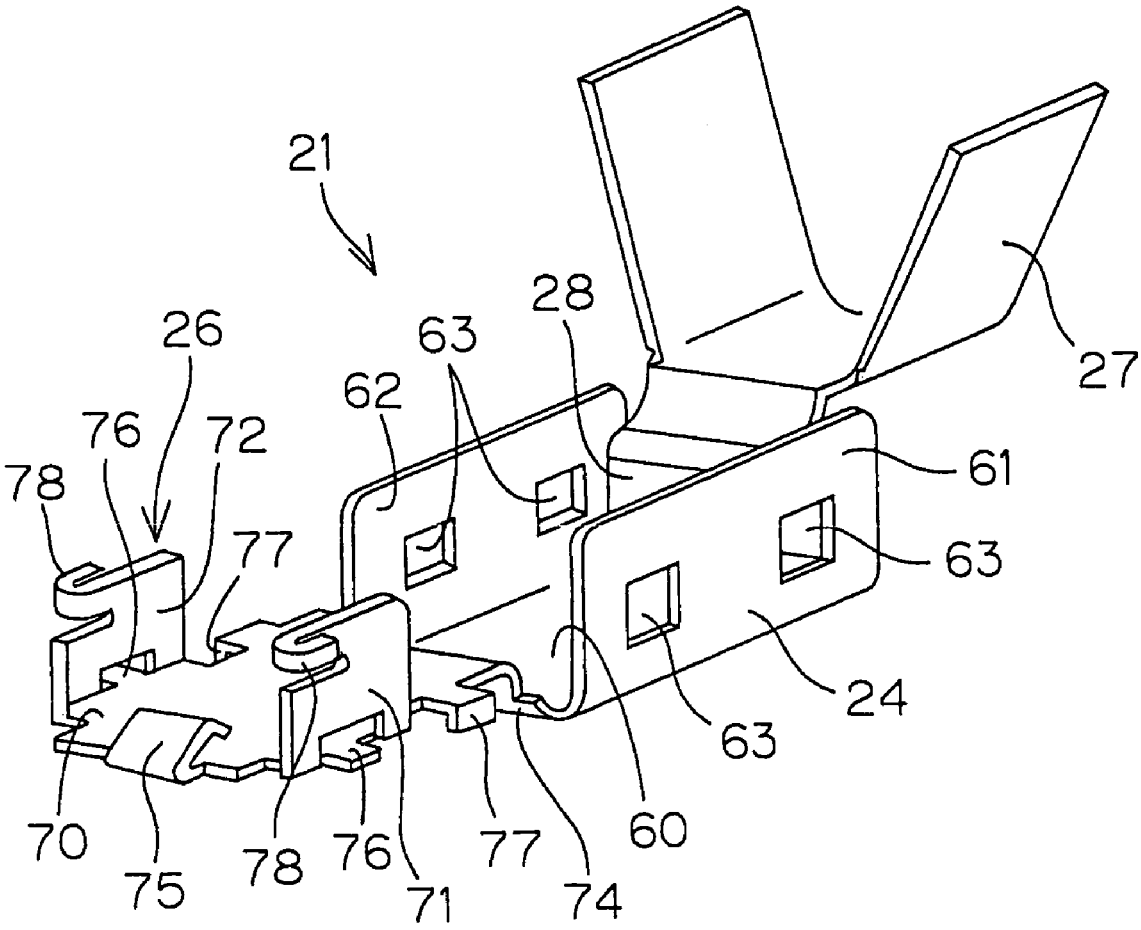
FIG. 5 is a perspective view of a first shell member.
Figure 6:
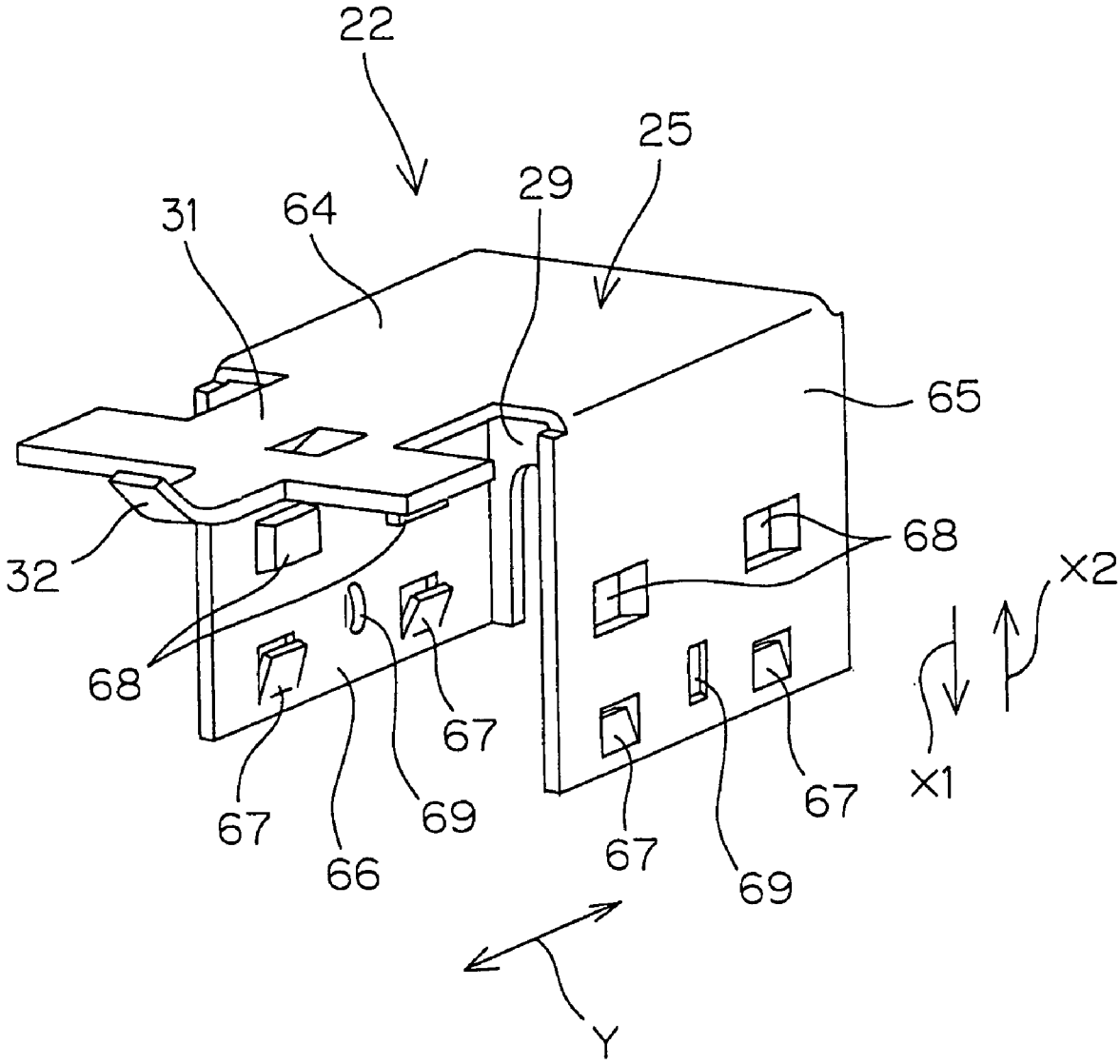
FIG. 6 is a perspective view of a second shell member.

As shown in FIGS. 5 and 6, the first and second shell members 22 respectively comprise groove-shaped main body sections 24 and 25. As shown in FIG. 2, the soldering section 20 is accommodated within a box-shaped space S formed by combining the main body sections 24 and 25 with each other.

As shown in FIG. 2, while a housing engagement section 26 engaged with the connector housing 14 is formed at a front end of the main body section 24 in the first shell member 21, the barrel 27 is formed at a rear end of the main body section 24 in the first shell member 21. The coating section 19 in the relay cable 7, together with the conductive shield 18 exposed to the coating section 19, is stuck by pressure to the barrel 27.

The main body sections 24 and 25 in the first and second shell members 21 and 22 respectively form walls 28 and 29 for electromagnetic shielding for shielding the defined space S against a region where the relay cable 7 extends. The walls 28 and 29 are respectively provided with holes through which the signal line 17 is to be inserted.

The wall 28 of the main body section 24 in the first shell member 21 forms an engagement section to be engaged with a receiving section 30 composed of a step in the cover housing 16A. Thus, when such a load as to pull the relay cable 7 out of the receptacle type connector 11 is exerted, therefore, the load is received by the receiving section 30 in the division housing 16A through the wall 28 serving as an engagement section in the first shell member 21. As a result, no unnecessary pulling load is exerted on the soldering section 20.

Referring to FIGS. 2 and 6, an extending section 31 along the third shell member 23 is formed forward from the main body section 25 in the second shell member 22. A front end of the extending section 31 extends toward the outside of the mounting flange 54 in the cover housing 16B, and the folded elastic tongue member 32 is provided in an extending manner at the front end thereof. As shown in FIG. 8, the elastic tongue member 32 is interposed between the reverse surface 9*a* of the body 9 of the electronic apparatus 1 and the division housing 16B in the cover housing 16, and is brought into press contact with the reverse surface 9*a* of the body 9, thereby achieving reliable grounding.

While conduction between the first shell member 21 and the second shell member 22 is ensured through the extending section 31, conduction between the first shell member 21 and the second shell member 22 which are combined with each other is also ensured. Accordingly, the whole of the shell 15 is reliably grounded to the body 9 through the elastic tongue member 32.

Referring to FIGS. 2 and 3, the receptacle type connector 11 has an insertion recess 33 opened forward in order to insert and extract an insertion projection (not shown) of the corresponding plug type connector 12. An insertion opening 34 to the insertion recess 33 is defined by the third shell member 23, while an innermost part of the insertion recess 33 is defined by first, second, and third walls 36, 37, and 38 (see FIG. 4) of the connector housing 14.

Figure 4:
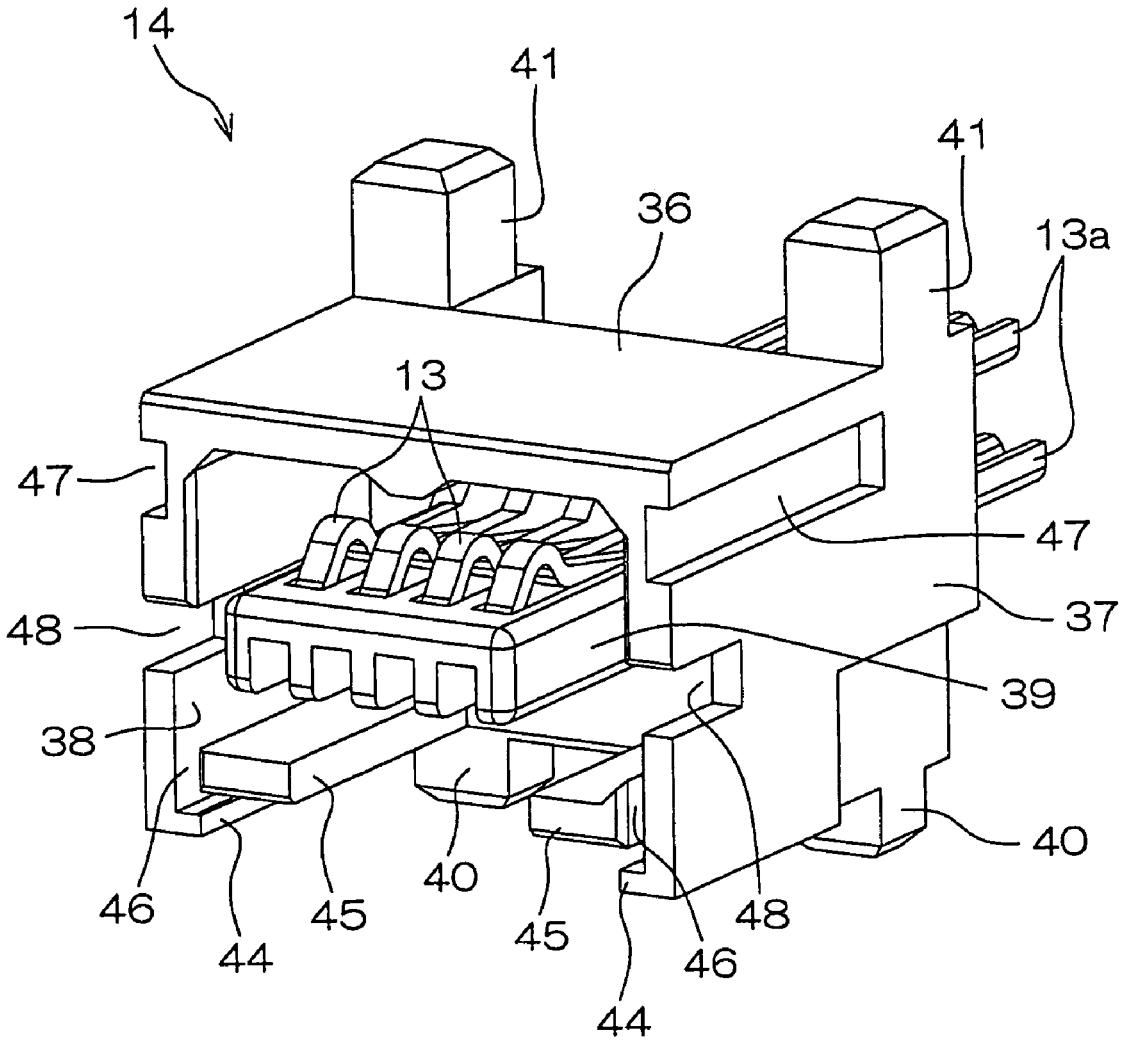
FIG. 4 is a perspective view of a connector housing in the receptacle type connector.

Referring to FIG. 4, the second walls 37 and 38 are opposed to each other, and the first wall 36 connects respective ends of the second and third walls 37 and 38 to each other. Further, the connector housing 14 has a contact holding wall 39 serving as an intermediate wall parallel to the first wall 36. The contact holding wall 39 has a plurality of contacts 13 lined up sideways and held therein, and the lead 13*a* at the rear end of each of the contacts 13 projects backward from the connector housing 14.

There are provided engagement projections 40 and 41 which respectively project toward the division housings 16A and 16B from the rear parts of the second and third walls 37 and 38. As shown in FIG. 2, the engagement projections 40 and 41 are respectively engaged with engagement grooves 42 and 43 in the corresponding division housings 16A and 16B in the cover housing 16, thereby regulating the back-and-forth movement of the connector housing 14 relative to the cover housing 16 in the direction in which the relay cable 7 extends.

The second and third walls 37 and 38 assume an angle shape in cross section by being respectively provided with edges 44 parallel to the first wall 36 at an end on the opposite side of the first wall 36. Further, a partition wall 45 extending parallel to the first wall 36 is formed in a state where it is in close proximity to each of the edges 44 and is also in close proximity to the second or third wall 37 or 38. An angle-shaped sliding groove 46 is formed between the wall 37 or 38 corresponding to each of the partition walls 45 and the corresponding edge 44.

Furthermore, the second and third walls 37 and 38 respectively have notch-shaped engagement grooves 47 associated with a projection 84 serving as a housing engagement section in the third shell member 23, as described later, and respectively have guide grooves 48 serving as guides when the first shell member 21 is sliding-mounted on the connector housing 14.

Referring to FIG. 5, the groove-shaped main body section 24 in the first shell member 21 has a main wall 60 and a pair of sidewalls 61 and 62 opposed to each other. The pair of sidewalls 61 and 62 is provided with a pair of engagement holes 63 used when the first shell member 21 is combined with the second shell member 22.

On the other hand, referring to FIG. 6, the groove-shaped main body section 25 in the second shell member 22 has a main wall 64 and a pair of sidewalls 65 and 66 opposed to each other. The pair of sidewalls 65 and 66 is covered so as to be respectively parallel to outer side surfaces of the corresponding sidewalls 61 and 62 of the first shell member 21. Further, on the pair of sidewalls 65 and 66 of the main body section 25 in the second shell member 22, elastic claws 67 respectively engaged with the engagement holes 63 in the pair of sidewalls 61 and 62 of the main body section 24 in the first shell member 21 are cut and raised inward.

Furthermore, the pair of sidewalls 65 and 66 of the second shell member 25 is respectively provided with a pair of projections 68 recessed and formed from outside so as to project inward.

As the main body section 25 in the second shell member 22 covers the main body section 24 in the first shell member 21 at the time of assembling, each of the elastic claws 67 is automatically engaged with the corresponding engagement hole 63, and each of the projections 68 is engaged with an edge of the corresponding sidewall 61 or 62 of the first shell member 21. The engagement of the projection 68 regulates the movement of the second shell member 22 in a downward direction X1, and the engagement of the elastic claw 67 regulates the movement of the second shell member 22 in an upward direction X2 and in a back-and-forth direction Y. Consequently, the first and second shell members 21 and 22 are firmly combined with each other while ensuring conduction. In FIG. 6, reference numeral 69 denotes an inward projection formed on each of the sidewalls 65 and 66. The projection 69 assumes a rib shape to contribute to improvement in strength.

Referring to FIG. 5 again, the housing engagement section 26 in the first shell member 21 has a main wall 70 constituting a peripheral wall surrounding the contact holding wall 39 in corporation with the first, second, and third walls 36, 37, and 38 of the connector housing 14 and a pair of sidewalls 71 and 72 opposed to each other, to assume a groove shape.

An engagement step 74 to be engaged with a stopper 73 in the division housing 16A in the cover housing 16 is formed between the main wall 60 of the main body section 24 and the main wall 70 of the housing engagement section 26.

An elastic projection 75 folded in an inclined manner for urging an insertion projection of the plug-type connector 12 to be inserted into the insertion recess 33 toward the contact holding wall 39 is provided at a front end of the main wall 70.

Further, the main wall 70 has a pair of projections 76 extending outward through openings formed at lower edges of the corresponding sidewalls 71 and 72. Projections 77 which project over the opposite side of the sidewalls 61 and 62 between the projection 76 and the engagement step 74 are respectively formed at both side edges of the main wall 70.

Furthermore, engagement members 78 folded outward and backward are respectively formed at front edges of the pair of sidewalls 71 and 72.

Referring to FIGS. 4 and 5, when the housing engagement section 26 in the first shell member 21 is mounted on the connector housing 14, the housing engagement section 26 is mounted by being slid from the front to the rear of the connector housing 14. At this time, however, the side walls 71 and 72 and the projections 76 are respectively introduced into the sliding grooves 46 in the connector housing 14, and the engagement members 78 are respectively introduced into the guide grooves 48 in the connector housing 14 so that sliding is guided. A rear end of the engagement member 78 is abutted against an innermost part of the guide groove 48 so that the positioning in the sliding direction of both the connector housing 14 and the first shell member 21 is achieved. At this time, the projection 77 is in a state along an inner side surface of the corresponding engagement projection 40 in the connector housing 14.

The engagement projection 40 in the connector housing 14, the projection 77 in the first shell member 21, and an engagement projection 85 in the third shell member 23 are fitted in the engagement groove 42 in the division housing 16A in the cover housing 16. Similarly, the engagement projection 41 in the connector housing 14 and an engagement projection 86 in the third shell member. 23 are fitted in the engagement groove 43 in the division housing 16B (only the engagement projections 40 and 41 in the connector housing 14 are illustrated in FIG. 2).

Figure 7:
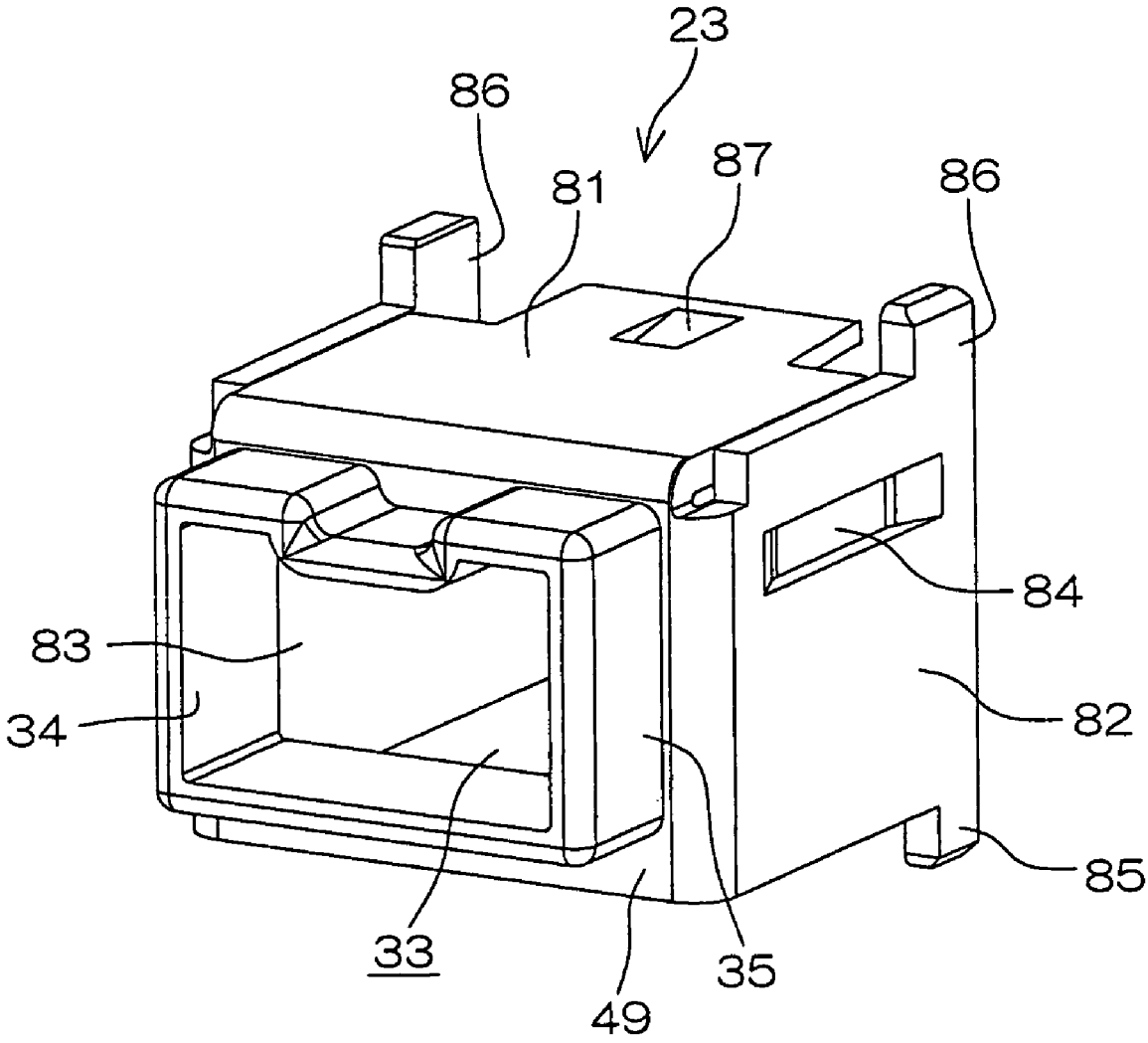
FIG. 7 is a perspective view of a third shell member.

Referring to FIG. 7, the third shell member 23 has a cylindrical section 35, which is approximately square in cross section, formed by a drawing operation for defining the insertion opening 34 of the insertion recess 33 in the receptacle type connector 11. A stepped section 49 in a square annular shape is formed so as to surround the cylindrical section 35, and first, second, and third sidewalls 81, 82, and 83 extending backward from the stepped section 49 are formed.

The second and third sidewalls 82 and 83 which are opposed to each other respectively have projections 84 serving as housing engagement sections which are recessed and formed so as to project inward and extend backward and forward. The engagement projections 85 and 86 which respectively project toward the division housings 16A and 16B are provided in an extending manner from rear ends of the second and third sidewalls 82 and 83.

An elastic member 87 projecting inward is cut and raised in a rear part of the first sidewall 81.

The third shell member 23 is sliding-mounted from the front of the connector housing 14. At this time, the projections 84 of the second and third sidewalls 82 and 83 are introduced into the engagement groove 47 in the connector housing 14 so that relative sliding between both the third shell member 23 and the connector housing 14 is guided. At a final end of the sliding, a rear surface of the stepped section 49 in the third shell member 23 is abutted against respective front ends of the walls 36, 37, 38 of the connector housing 14, and the elastic member 87 in the first sidewall 81 of the third shell member 23 is engaged with a rear edge of the first wall 36 of the connector housing 14 so that relative movement in a back-and-forth direction between both the connector housing 14 and the third shell member 23 is regulated.

In a state where the first and third shell members 21 and 23 are mounted on the connector housing 14, the first, second, and third sidewalls 81, 82, and 83 of the third shell member 23 and the main wall 70 of the housing engagement section 26 in the first shell member 21 assume a box shape, to surround the connector housing 14, thereby enhancing a shielding effect.

When the receptacle type connector 11 is assembled at the end of the relay cable 7, the following procedure 1) to 5) is carried out.

1) The soldering section 20 is first provided by soldering the stripped end of the corresponding signal line 17 in the relay cable 7 to the lead 13*a* at the rear end of each of the contacts 13 held in the connector housing 14.

2) After the first shell member 21 is then mounted on the connector housing 14, the coating section 19 in the relay cable 7, together with the conductive shield 18 exposed over the coating section 19, is stuck by pressure by the barrel 27 in the first shell member 21.

3) The third shell member 23 is then mounted from the front of the connector housing 14.

4) The second shell member 22 is then mounted to form the sub-assembly SA as shown in FIG. 3 by combining the main body section 25 in the second shell member 22 with the main body section 24 in the first shell member 21 and making the extending section 31 in the second shell member 22 parallel along the first sidewall 81 of the third shell member 23.

5) Both the main sections 51 and 52 in both the division housings 16A and 16B are then fitted with spigot joint in a state where the sub-assembly SA is held between the main sections 51 and 52.

As described in the foregoing, according to the present embodiment, in the receptacle type connector 11 serving as an inlet of input to the electronic apparatus 1, the metal shell 15 is grounded to the body 9 of the electronic apparatus 1, thereby making it possible to prevent the generation of such radiation noises from the relay cable 7 that affect the components in the electronic apparatus 1. That is, outside noises can be shut out at the inlet to the electronic apparatus 1 so as not to affect the ground line in the circuit board 3.

Furthermore, the pulling load of the relay cable 7 is received by the cover housing 16 through the shell 15, thereby making it possible to prevent the soldering section 20 in the signal line 17 in the relay cable 7 from being damaged.

As the shell 15, the plurality of divided shell members 21, 22, and 23 are combined with one another to assume a box shape, thereby making it possible to enhance a shielding effect while achieving miniaturization thereof. Since the contact 13 and the corresponding signal line 17 can be soldered to each other in a state where the periphery of the connector housing 14 is opened before the shell members 21, 22, and 23 are combined with the connector housing 14, work is easy to perform. Further, in sticking the coating section 19 or the like in the relay cable 7 by pressure to the barrel 27 in the first shell member 21 after the soldering, the second and third shell members 22 and 23 are not mounted so that the relay cable 7 is easy to wind, thereby making it possible to stick the relay cable 7 by pressure to an accurate position of the first shell member 21.

It is preferable that the shell 15 is divided into the first, second, and third shell members 21, 22, and 23 so that different constituent materials can be set as the first, second, and third shell members 21, 22, and 23 respectively constituting the areas of the shell 15 in conformity with functions required for the each members.

The insertion opening 34 is defined by the cylindrical section 35 formed by a drawing operation of the third shell member 23, thereby making it possible to make the strength of the insertion opening 34 higher, as compared with that in a case where a plate material is folded to assume an annular shape.

A backward shielding effect can be enhanced by the walls 28 and 29 for electromagnetic shielding of the main body sections 24 and 25 in the first and second shell members 21 and 23.

It is preferable in terms of strength that the pulling load of the relay cable 7 can be firmly received by a relatively large area through the wall 28 of the main body section 24 in the first shell member 21.

Further, the elastic tongue member 32 extending from the second shell member 22 is brought into press contact with the reverse surface 9*a* of the body 9 while ensuring mutual conduction among the shells 21, 22, and 23 which are combined with one another, thereby making it possible to reliably ground the elastic tongue member 32.

The present invention is not limited to the above-mentioned embodiment. For example, a cover housing 16 may be constructed by combining a division housing 16C having no mounting flange and a division housing 16D integrally having mounting flanges 53 and 54, and the mounting flanges 53 and 54 may be further arranged so as to extend in a direction perpendicular to the direction in which both the division housings 16C and 16D are combined with each other.

Although the present invention has been described and illustrated in detail by the specific embodiment, it is clearly understood that the same is by way of illustration and example only and is not to be taken by way of limitation, the spirit and scope of the present invention being limited only by the terms of the appended claims.

The invention claimed is:

1. A transmission device arranged in an electronic apparatus having a circuit board for input and/or output and a conductive body, comprising:

a relay cable having first and second ends, the first end of the relay cable being connected to the circuit board; and a receptacle type connector provided at the second end of the relay cable and attached to a reverse surface of the body of the electronic apparatus, the receptacle type connector comprising an insulative connector housing holding a plurality of contacts, and a conductive metal shell surrounding at least a part of the connector housing, the conductive metal shell including an elastic tongue member and a cylindrical section defining an insertion recess for access to the plurality of contacts, the elastic tongue member in a normal state and the cylindrical section being disposed forward of the insulative connector housing relative to an insertion direction of the transmission device into the electronic apparatus, the conductive metal shell being grounded to the conductive body by contact with the elastic tongue that moved from the normal state to a resiliently biased state against the conductive body and the insulative connector housing being disposed between the plurality of contacts and the conductive metal shell.

2. The transmission device according to claim 1, wherein the receptacle type connector further comprises a cover housing holding the connector housing and the shell and attached to the reverse surface of the body of the electronic apparatus.

3. The transmission device according to claim 2, wherein the relay cable comprises a plurality of coated signal lines, a conductive shield surrounding the coated signal lines, and a coating section surrounding the conductive shield, and each of the contacts in the receptacle type connector and a stripped end of the corresponding signal line in the relay cable are connected to each other by a soldering section.

4. The transmission device according to claim 3, wherein there is provided coupling means for coupling the shell and the coating section in the relay cable, and the cover housing is provided with a receiving section for receiving, when such a load as to pull the relay cable out of the receptacle type connector is exerted, the load through the shell.

5. The transmission device according to claim 4, wherein the coupling means comprises a barrel provided in the shell, the coating section at the second end of the relay cable, together with an end of the conductive shield exposed from the coating section, being stuck by pressure to the barrel.

6. The transmission device according to claim 4 or 5, wherein the shell comprises an engagement section to be engaged with the receiving section in the cover housing, the receiving section in the cover housing receiving, when such a load as to pull the relay cable out of the receptacle type connector is exerted, the load through the engagement section in the shell.

7. The transmission device according to any one of claims 2 to 5, wherein the elastic tongue member is interposed between the reverse surface of the body of the electronic apparatus and the cover housing and brought into press contact with the reverse surface of the body.

8. The transmission device according to claim 3, 4 or 5, wherein the shell comprises first, second, and third shell members, the first and second shell members respectively comprising groove-shaped main body sections, the main body sections in the first and second shell members being combined with each other to assume the shape of a box accommodating the soldering section.

9. The transmission device according to claim 8, wherein a housing engagement section to be engaged with the connector housing is formed at a front end of the main body section in the first shell member, and the barrel is formed at a rear end of the main body section in the first shell member, and the third shell member is sliding-mounted from its front on the connector housing, to assume the shape of a box in cooperation with the housing engagement section in the first shell member.

10. The transmission device according to claim 8, wherein the third shell member comprises a cylindrical section for defining an insertion opening of the receptacle type connector, the cylindrical section being press-formed by a drawing operation.

11. The transmission device according to claim 8, wherein at least two of the first, second and third shell members are respectively formed of different materials.

12. The transmission device according to claim 8, wherein the main body sections in the first and second shell members respectively comprise walls for electromagnetic shielding, the walls for electromagnetic shielding a box-shaped space defined by the main body sections in the first and second shell members which are combined with each other from a region where the relay cable extends.

13. The transmission device according to claim 8, wherein the engagement section to be engaged with the receiving section in the cover housing is provided in the wall for electromagnetic shielding in the main body section in the first shell member.

14. A transmission device arranged in an electronic apparatus having a circuit board for input and/or output and a conductive body, comprising:

a relay cable having first and second ends, the first end of the relay cable being connected to the circuit board; and a receptacle type connector provided at the second end of the relay cable and attached to a reverse surface of the body of the electronic apparatus, the receptacle type connector comprising an insulative connector housing holding a plurality of contacts, and a conductive metal shell surrounding at least a part of the connector housing, the shell being grounded to the body, wherein the receptacle type connector further comprises a cover housing holding the connector housing and the shell and attached to the reverse surface of the body of the electronic apparatus, wherein the relay cable comprises a plurality of coated signal lines, a conductive shield surrounding the coated signal lines, and a coating section surrounding the conductive shield, and each of the contacts in the receptacle type connector and a stripped end of the corresponding signal line in the relay cable are connected to each other by a soldering section, wherein the shell comprises first, second, and third shell members, the first and second shell members respectively comprising groove-shaped main body sections, the main body sections in the first and second shell members being combined with each other to assume the shape of a box accommodating the soldering section, and wherein the second shell member comprises an extending section extending from the main body section and along the third shell member, and an elastic tongue member extending in a folded shape from the extending section, the elastic tongue member being interposed between the reverse surface of the body of the electronic apparatus and the cover housing and brought into press contact with the reverse surface of the body.

15. The transmission device according to any one of claims 2 to 5, wherein the cover housing comprises a pair of division housings which are combined with each other in such a manner that the connector housing and the shell in the receptacle type connector are accommodated therebetween.

* * * * *